US010636641B2

(12) United States Patent
Zhang et al.

(10) Patent No.: US 10,636,641 B2
(45) Date of Patent: Apr. 28, 2020

(54) PROTON TRANSFER REACTION MASS SPECTROMETER

(71) Applicant: SHIMADZU CORPORATION, Kyoto-shi, Kyoto (JP)

(72) Inventors: Xiaoqiang Zhang, Shanghai (CN); Wenjian Sun, Shanghai (CN)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 16/020,025

(22) Filed: Jun. 27, 2018

(65) Prior Publication Data

US 2019/0013191 A1 Jan. 10, 2019

(30) Foreign Application Priority Data

Jul. 10, 2017 (CN) ..... 2017 1 0554756

(51) Int. Cl.
*H01J 49/04* (2006.01)
*H01J 49/06* (2006.01)
(Continued)

(52) U.S. Cl.
CPC ..... *H01J 49/0422* (2013.01); *H01J 49/062* (2013.01); *H01J 49/145* (2013.01); *H01J 49/34* (2013.01)

(58) Field of Classification Search
USPC ..... 250/286, 288
See application file for complete search history.

(56) References Cited

U.S. PATENT DOCUMENTS 6,639,213 B2 10/2003 Gillig et al.
2012/0003748 A1* 1/2012 Robinson ..... H01J 49/105 436/173
(Continued)

FOREIGN PATENT DOCUMENTS

CN 101675496 A 3/2010
CN 101855700 A 10/2010
(Continued)

OTHER PUBLICATIONS

Barber, Shane, et al., "Increased Sensitivity in Proton Transfer Reaction Mass Spectrometry by Incorporation of a Radio Frequency Ion Funnel", Analytical Chemistry, vol. 84, Issue 12, pp. 5387-5391, Published: May 21, 2012.
(Continued)

*Primary Examiner* — Kiet T Nguyen
(74) *Attorney, Agent, or Firm* — Tim Tingkang Xia, Esq.; Locke Lord LLP

(57) ABSTRACT

A mass spectrometer includes an ion source configured to generate reagent ions; a drift tube configured to cause sample molecules to react with the reagent ions to generate sample ions, the drift tube comprising two sets of electrodes which are identical in structure and symmetrically distributed in a direction perpendicular to a direction of ion drift, each set of electrodes comprising a plurality of curved cell electrodes which are distributed in a same plane and arranged in the direction of ion drift so that the sample ions are generated and drifted within a region between the two sets of electrodes and focused in the direction perpendicular to the direction of ion drift; a power supply device configured to apply, to each of the cell electrodes, a DC voltage changing in the direction of ion drift; and, a mass analyzer configured to perform mass analysis for the sample ions.

14 Claims, 9 Drawing Sheets

(51) Int. Cl.
*H01J 49/14* (2006.01)
*H01J 49/34* (2006.01)

(56) References Cited

U.S. PATENT DOCUMENTS

| | | | | |
|---|---|---|---|---|
| 2014/0217275 | A1* | 8/2014 | Ding | H01J 49/027 250/282 |
| 2015/0129762 | A1* | 5/2015 | Campbell | H01J 49/0031 250/283 |
| 2016/0189948 | A1* | 6/2016 | Breitenlechner | H01J 49/063 422/83 |
| 2017/0200597 | A1* | 7/2017 | Giles | H01J 49/065 |
| 2017/0236698 | A1* | 8/2017 | Zhang | H01J 49/062 250/296 |
| 2018/0108522 | A1* | 4/2018 | Sulzer | H01J 49/168 |

FOREIGN PATENT DOCUMENTS

| | | | |
|---|---|---|---|
| CN | 103493173 | A | 1/2014 |
| CN | 104170053 | A | 11/2014 |
| CN | 105470094 | A | 4/2016 |
| CN | 106663590 | A | 5/2017 |

OTHER PUBLICATIONS

Brown, Phil A. et al., "Implementation and characterization of an RF ion funnel ion guide as a proton transfer eaction chamber", International Journal of Mass Spectrometry, vol. 414, pp. 31-38, Available online: Jan. 5, 2017.

Blase, Ryan C. et al., "Increased ion transmission in IMS: A high resolution, periodic-focusing DC ion guide ion mobility spectrometer", International Journal of Mass Spectrometry, vol. 301, Issues 1-3, pp. 166-173, Available online: Aug. 26, 2010.

SIPO, "Chinese Office Action for CN Application No. 201710554756.4", China, dated Dec. 16, 2019.

* cited by examiner

PROTON TRANSFER REACTION MASS SPECTROMETER

CROSS-REFERENCE TO RELATED APPLICATION

This application claims the priority to Chinese Patent Application No. 201710554756.4, filed Jul. 10, 2017, in the State Intellectual Property Office of P.R. China, which are incorporated herein in their entireties by reference.

FIELD OF THE INVENTION

The present invention relates to the technical field of mass spectrometry and in particular to a proton transfer reaction mass spectrometer.

BACKGROUND OF THE INVENTION

As an important mass spectrometry technique, the Proton Transfer Reaction Mass Spectrometry (PTR-MS) is generally used for gas analysis. Specifically, at first gas sample molecules to be analyzed and pre-prepared reagent ions (generally, $H_3O^+$) are subjected to a proton transfer reaction to obtain sample ions, and the sample ions are analyzed by a mass spectrometer. The proton transfer reaction is carried out within a drift tube having a length of 10-30 cm and an air pressure of 1-2 torr, and a DC electric field is applied across the drift tube to drive the generated sample ions to the next stage. The time for the proton transfer reaction is determined by the value of E/N in the drift tube, wherein E is the intensity of the DC electric field, and N is the number density of the gas molecules. Once the reaction time is determined, the concentration of the sample ions can be calculated according to the constant of the reaction rate of the sample and the reagent ions, the intensity of the reagent ions and the sample ions measured by the mass spectrometer and the instrument parameters. Therefore, in the PTR-MS, the concentration of the sample gas can be accurately measured in real time without external calibration or internal calibration theoretically.

In the PTR-MS, the value of the E/N in the drift tube is very important to the quality of the mass spectrum. If the value of the E/N is too small, the reagent ions $H_3O^+$ are likely to form cluster ions with water molecules, leading to a complexed mass spectrum. If the value of E/N is too large, then too high ion energy will be caused although the formation of clusters is inhibited, and hence it is likely to generate fragment ions or trigger other reactions to generate interfering ions, which introduces interference in the spectrum. Typically, an appropriate value of E/N can be 120 Td, where 1 Td is about $10^{-17}$ V·cm$^2$.

It should be noted that, since the DC electric field in the drift tube cannot confine the sample ions in the radial direction, the ions will be freely diffused in the radial direction when passing through the drift tube. When the ions are transmitted to the succeeding stage through a pore used for flow limiting in vacuum, about 90% of the ions will be lost. As a result, the sensitivity is reduced.

In order to improve the transmission efficiency, recently, some researchers have introduced the ion funnel technology into the PTR-MS, for example, as described in the document "Anal. Chem. 2012, 84, 5387-5391" or "Int. J. Mass Spectrom. 414 (2017) 31-38". The ion funnel to which an RF voltage is applied can effectively focus ions, and thus realize above 10× ion transmission efficiency. However, an RF electric field capable of trapping ions effectively will dramatically heat the ions. Consequently, the value of E/N is too large and too many fragment ions will thus be generated, thereby seriously interfering the spectrum. In addition, the RF electric field is characterized by mass selection or discrimination against ions, and thus it is not ideal for many situations.

On the other hand, in the U.S. Pat. No. 6,639,213 and the document "Int. J. Mass Spectrom. 301 (2011) 166-173", an ion drift tube for analyzing the ion mobility has been proposed, wherein, by a small radius of the drift tube and a proper ratio of radius/spacing, a DC electric field can be used to periodically focus ions, and a high transmission efficiency can be realized without significantly reducing the resolution of the ion mobility spectrum. Conceivably, if a similar drift tube is applied to the proton transfer reaction mass spectrometer, a high transmission efficiency can be achieved without additional ion heating. However, actually, this periodic focusing device can only ensure that the size of an incident ion pack will not be enlarged overly due to diffusion, but it cannot further compress the ion beam having a large incident cross-section. This device is actually a one-dimensional ion transmission device which does not have a real ion focusing or ion compression function. The drift tube in the proton transfer reaction mass spectrometry usually requires a large reaction region to ensure its sensitivity. Hence this device is not applicable.

Therefore, it is necessary to provide a proton transfer reaction mass spectrometer which can ensure a high transmission efficiency of high-throughput sample ions in a drift tube and meanwhile will not generate fragment ions so that the spectrum quality is ensured.

SUMMARY OF THE INVENTION

An objective of the present invention is to provide a mass spectrometer which can realize high-throughput and high-efficiency ion transmission within a drift tube without significantly heating ions so that a high sensitivity and a high spectrum quality are achieved.

In order to achieve the objective and other related objectives, the present invention provides a mass spectrometer, including: an ion source configured to generate reagent ions; a drift tube configured to cause sample molecules to react with the reagent ions to generate sample ions, the drift tube including two sets of electrodes which are identical in structure and symmetrically distributed in a direction perpendicular to a direction of ion drift, each set of electrodes including a plurality of curved cell electrodes which are distributed in a same plane and arranged in the direction of ion drift so that the sample ions are generated and drifted within a region between the two sets of electrodes and focused in the direction perpendicular to the direction of ion drift; a power supply device configured to apply, to each of the cell electrodes, a DC voltage changing in the direction of ion drift, a DC electric field formed by the DC voltage being used for ion drift; and, a mass analyzer configured to perform mass analysis for the sample ions.

In an embodiment of the present invention, the cell electrodes are ring or arc electrodes, and each set of the electrodes includes several ring or arc electrodes which are distributed in a same plane, have a same center and different radii and extend in the direction of ion drift.

In an embodiment of the present invention, the cross-section of each of the ring or arc electrodes in a direction perpendicular to an ring shape or arc shape is circular or elliptic.

In an embodiment of the present invention, a ratio of a distance between two cell electrodes distributed in the direction perpendicular to the direction of ion drift to a width of each cell electrode in the direction of ion drift does not exceed 2, and a ratio of the distance between two cell electrodes distributed in the direction perpendicular to the direction of ion drift to a length of a distance between two adjacent cell electrodes in the direction of ion drift does not exceed 2.

In an embodiment of the present invention, the DC voltage applied by the power supply device changes uniformly or non-uniformly in the direction of ion drift, to form a periodic DC focusing electric field in the direction of ion drift.

In an embodiment of the present invention, the width of the cell electrodes in the direction of ion drift or a spacing between adjacent cell electrodes in the direction of ion drift changes in the direction of ion drift, to form a periodic DC focusing electric field in the direction of ion drift.

In an embodiment of the present invention, the DC voltage is a DC voltage in a form of traveling waves.

In an embodiment of the present invention, the power supply device is further configured to apply RF voltages to at least part of cell electrodes in each set of the electrodes, and the RF voltages on adjacent cell electrodes to which the RF voltages are applied in the direction of ion drift are equal in amplitude and opposite in phase.

In an embodiment of the present invention, the cell electrodes are broken line electrodes, and each set of the electrodes includes several broken line electrodes which are distributed in a same plane, have a same axis of symmetry and are arranged in the direction of ion drift.

In an embodiment of the present invention, the reagent ions are one of inert gas ions, $H_3O^+$, $NO^+$ and $O_2^+$ or a combination thereof.

In an embodiment of the present invention, the mass spectrometer further includes an ion selection device which is located in a preceding stage of the drift tube to select one or more of the reagent ions.

In an embodiment of the present invention, a pressure in the drift tube ranges from 100 Pa to 400 Pa.

In an embodiment of the present invention, the mass analyzer is a quadrupole mass filter, a time-of-flight mass analyzer, an ion trap mass analyzer or a Fourier transform mass analyzer.

In an embodiment of the present invention, each set of the electrodes is distributed on a same printed circuit board substrate.

In an embodiment of the present invention, the reagent ions or the sample molecules are introduced from an annular or arc-shaped inlet into the drift tube for reaction.

As described above, the mass spectrometer of the present invention has the following beneficial effects:

compared with a DC electric field drift tube in the prior art, the drift tube of a particular structure can realize high ion transmission efficiency and thus can ensure high sensitivity; and, compared with an RF electric field drift tube, the drift tube of a particular structure can effectively avoid the effect of heating ions and meanwhile avoid mass discrimination, and thus a high spectrum quality can be ensured, and moreover, the device is simpler.

DETAILED DESCRIPTION OF THE INVENTION

Implementations of the present invention will be described below by specific embodiments, and other advantages and effects of the present invention can be easily appreciated from the contents disclosed in the description by those skilled in the art.

It is to be noted that, the structure, scale, size and the like shown in the accompanying drawings of the description are merely used for allowing those skilled in the art to understand and read the contents disclosed in the description and not intended to limit the implementable conditions of the present invention, and thus have no any technically substantive meaning. Without influencing the effects and objectives which may be achieved by the present invention, any structural modification, changes in scale, or size adjustments shall fall into the scope defined by the technical contents of the present invention. Meanwhile, terms such as "upper", "lower", "left", "right", "middle" and "one" used in the description are merely used for clear statement and not intended to limit the implementable scope of the present invention, and any changes or adjustments in relative relations shall be regarded as falling into the implementable scope of the present invention without substantively changing the technical contents.

The mass spectrometer of the present invention includes: an ion source configured to generate reagent ions; a drift tube configured to cause sample molecules to react with the reagent ions to generate sample ions, the drift tube including two sets of electrodes which are identical in structure and symmetrically distributed in a direction perpendicular to a direction of ion drift, each set of electrodes including a plurality of curved cell electrodes which are distributed in a same plane and arranged in the direction of ion drift so that the sample ions are generated and drifted within a region between the two sets of electrodes and focused in the direction perpendicular to the direction of ion drift; a power supply device configured to apply, to each of the cell electrodes, a DC voltage changing in the direction of drift, a DC electric field formed by the DC voltage being used for ion drift; and, a mass analyzer configured to perform mass analysis for the sample ions.

The mass spectrometer of the present invention will be described below in detail with reference to specific embodiments.

Embodiment 1

Figure 1:
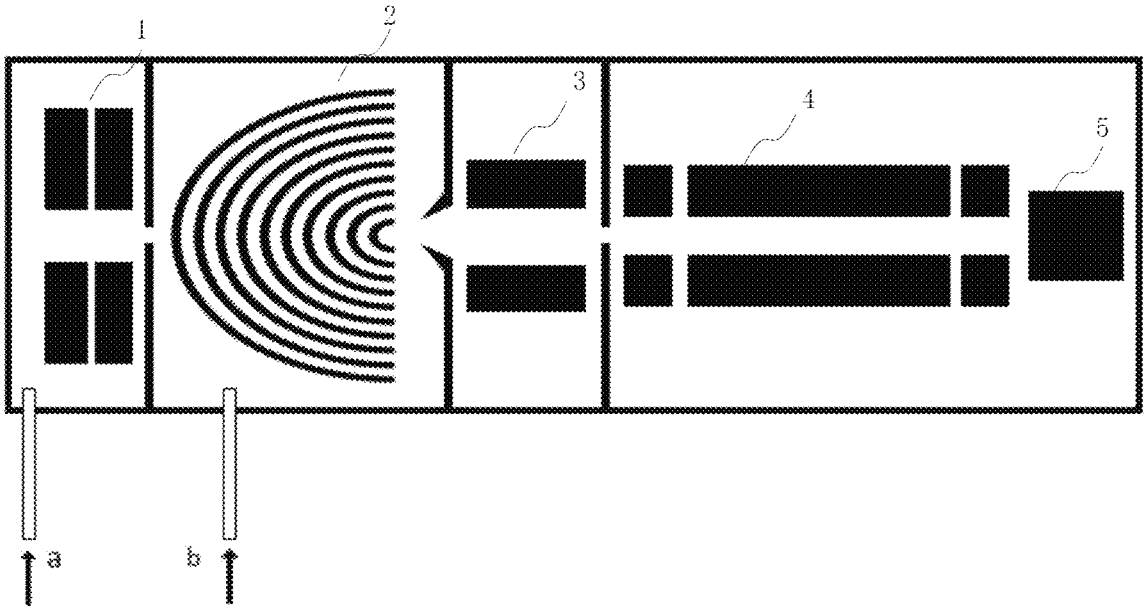
FIG. 1 shows a structure diagram of a first embodiment of a mass spectrometer according to the present invention.

As shown in FIG. 1, in Embodiment 1, the mass spectrometer of the present invention includes:

an ion source 1 configured to generate reagent ions.

Figure 12:
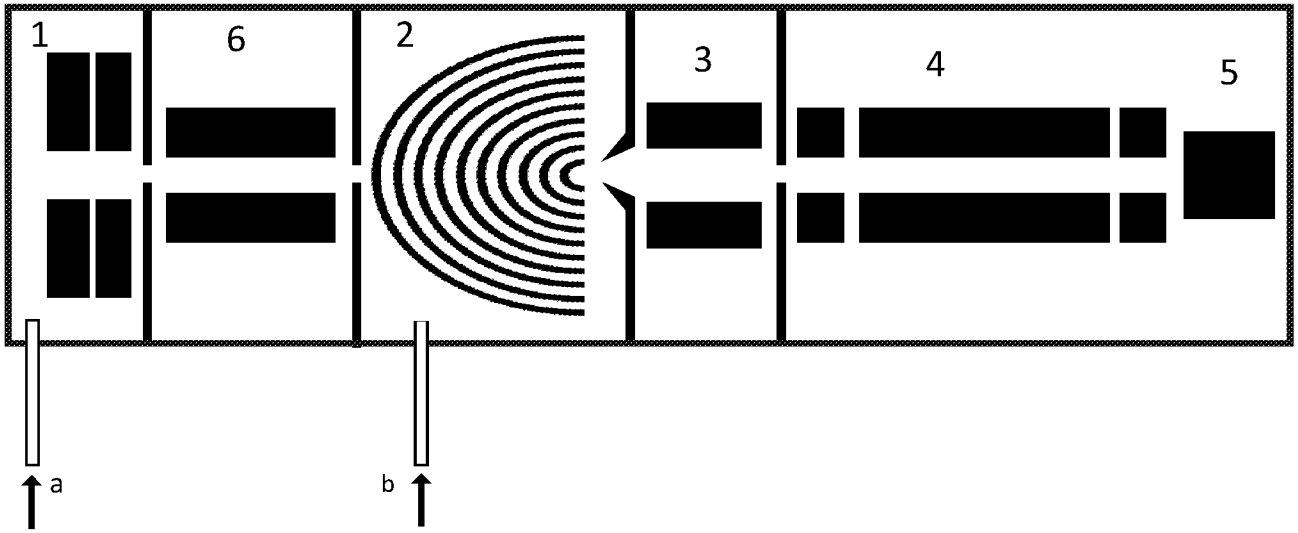
FIG. 12 shows a mass spectrometer comprising an ion selection device which is located in a preceding stage of the drift tube to select one or more of the reagent ions according to one embodiment of the present invention.

Specifically, the ion source 1 ionizes a reagent gas entering from an inlet a to generate reagent ions. Preferably, the ion source 1 may be a hollow cathode discharge lamp, a radiation source, a microwave plasma source, an electron bombardment ion source or an ion source of other types. The reagent gas may be water vapor, NO, $O_2$, an inert gas or the like. Accordingly, the reagent ions are preferably one of the following ions or a combination thereof: $H_3O^+$, $NO^+$, $O_2^+$ or inert gas ions, for example, $Kr^+$ or the like. Preferably, the mass spectrometer further includes an ion selection device 6, which is located in a preceding stage of the drift tube 2 to quickly select one or more of the reagent ions, as shown in FIG. 12.

The drift tube 2 is configured to cause sample molecules to react with the reagent ions to generate sample ions. The drift tube 2 includes two sets of electrodes which are identical in structure and symmetrically distributed in a direction perpendicular to a direction of ion drift. Each set of the electrodes includes a plurality of arc cell electrodes which are distributed in the same plane and arranged in the direction of ion drift so that the sample ions are generated and drifted within a region between the two sets of electrodes and focused in the direction perpendicular to the direction of ion drift.

Preferably, the pressure in the drift tube ranges from 100 Pa to 400 Pa. The drift tube has two functions: firstly, the drift tube functions as a reaction chamber for causing the sample gas to react with the reagent ions to generate sample ions, wherein the sample gas enters the chamber of the drift tube 2 from an inlet b of the chamber where the drift tube is located; and secondly, the drift tube functions as an ion guide device 3 for drifting and transmitting the sample ions to the succeeding stage.

The power supply device (not shown) is configured to apply, to each of the cell electrodes, a DC voltage changing in the direction of ion drift. ADC electric field formed by the DC voltage is used for ion drift. The DC voltage changes uniformly or non-uniformly in the direction of ion drift, to form a periodic DC focusing electric field in the direction of ion drift.

Preferably, the DC voltage is a static DC voltage. However, the DC voltage may be a DC voltage in the form of traveling waves.

The ion guide device 3 is connected to the drift tube 2 to guide the sample ions to a mass analyzer.

The mass analyzer 4 is connected to the ion guide device 3 to perform mass analysis for the sample ions.

Preferably, the mass analyzer may be a quadrupole mass filter, a time-of-flight mass analyzer, an ion trap mass analyzer or a Fourier transform mass analyzer.

A detection device 5 is connected to the mass analyzer 4 to detect the sample ions after being subjected to the mass analysis so as to obtain a mass spectrum.

Figure 2:
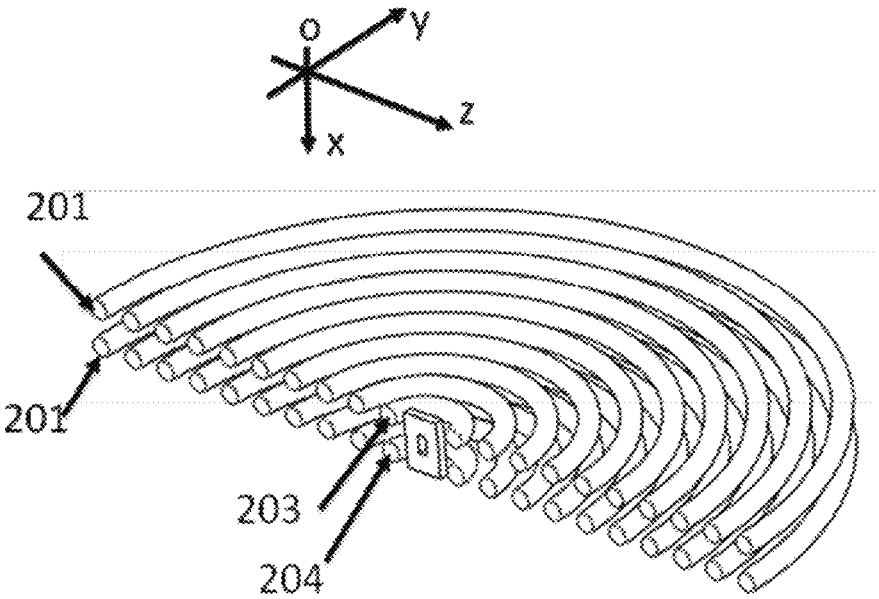
FIG. 2 shows a three-dimensional structure diagram of a drift tube in the first embodiment of the mass spectrometer according to the present invention.

The structure of the drift tube 2 in this embodiment will be described below in detail. As shown in FIG. 2, the drift tube 2 includes two sets of electrodes which are identical in structure and symmetrically distributed in a direction perpendicular to a direction of ion drift, wherein each set of electrodes includes a plurality of concentric arc electrodes (shown as semi-annular electrodes in the figure) which are distributed in the same plane (i.e., the yz plane), and the arc electrodes (i.e., arc electrodes having an equal radius) in one-to-one correspondence in the two sets of electrodes are distributed in the direction (i.e., x-axis) perpendicular to the direction of ion drift. The region between the two sets of electrodes is a region within which the sample molecules are reacted with the reagent ions to generate sample ions and ion drift is then performed.

In a typical ion drift process, the reagent ions enter the reaction region from a region near the arc electrodes 201 and 202 having a larger radius on the outer side and then react with the sample molecules; the generated sample ions and the remaining reagent ions are focused and transmitted (or drifted) to a region near the arc electrodes 203 and 204 having a smaller radius in the radial direction, until they are gradually focused to the vicinity of the center in the radial direction and eventually introduced into the ion guide device 3 in the succeeding stage from an ion outlet.

Figure 13:
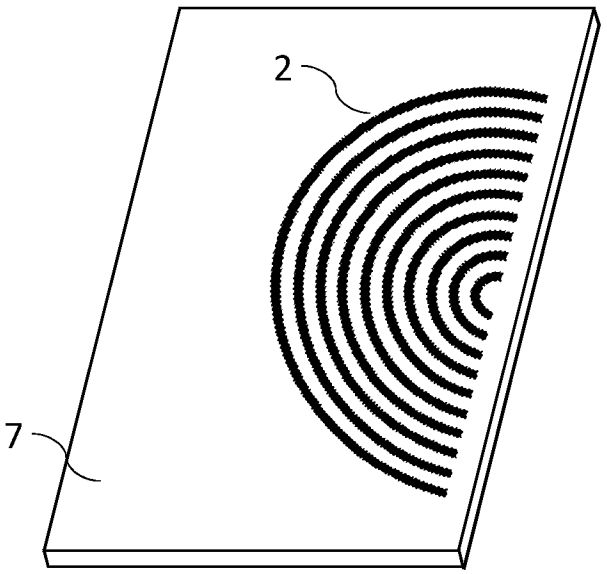
FIG. 13 shows a mass spectrometer where each set of electrodes is distributed on a same printed circuit board substrate according to one embodiment of the present invention.

Preferably, each set of electrodes can be conventional metal electrodes or can be manufactured by a PCB (Printed Circuit Board) process, so that all electrodes 2 are distributed on the same printed circuit board substrate 7, as shown in FIG. 13. Thus, the manufacturing process is simplified and the manufacturing cost is reduced.

Preferably, the ratio of the distance between two cell electrodes distributed in the direction (i.e., the x direction) perpendicular to the direction of ion drift to the width of each cell electrode in the direction of ion drift (i.e., the radial direction) does not exceed 2, and the ratio of the distance between two cell electrodes distributed in the direction (i.e., the x direction) perpendicular to the direction of ion drift to the length of the distance between two adjacent cell electrodes in the direction of ion drift (i.e., the radial direction) does not exceed 2. By this ratio, periodic focusing or defocusing in the x direction is realized, and the ions are prevented from losing on the electrodes.

Figure 3:
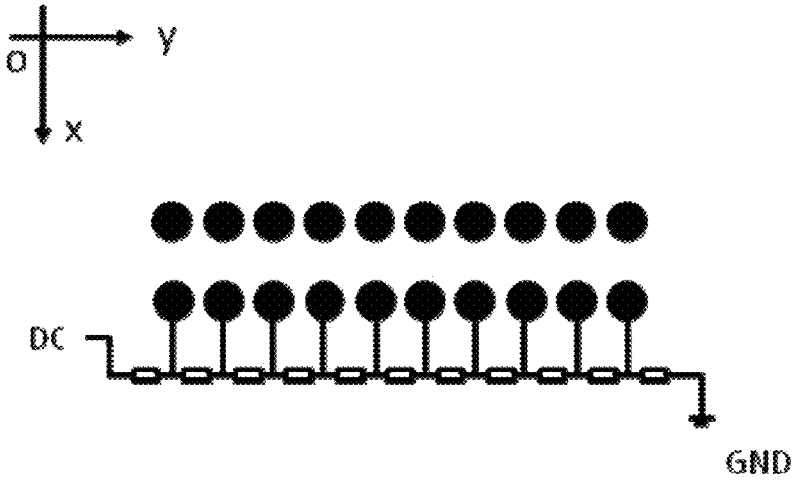
FIG. 3 shows a schematic diagram of applying a DC voltage to the drift tube in the first embodiment of the mass spectrometer according to the present invention.

In the simplest case, the arc electrodes are identical in both width and spacing in the radial direction, and the power supply device applies a DC voltage changing uniformly in the direction of ion drift to form a periodic DC focusing electric field in the direction of ion drift. As shown in FIG. 3, the resistance of each resistor is equal.

If the cross-section of each of the arc-shaped electrodes in a direction perpendicular to the arc shape is rectangular, high-efficiency ion transmission cannot be realized. Unlike the conventional periodic DC focusing devices, since the periodical change in the DC gradient (i.e., electric field intensity) of the electrodes will be damaged with the reduction of the radius of the arc electrodes, the ions will be overly defocused in the x direction and thus lost on the electrodes.

In order to realize the periodic focusing in the x direction and also realize the focusing or compression of ion beams in the yx plane, the mass spectrometer of the present invention can employ the following solutions.

(1) The cross-section of each of the arc-shaped electrodes in a direction perpendicular to the arc shape is circular or elliptic.

Figure 4:
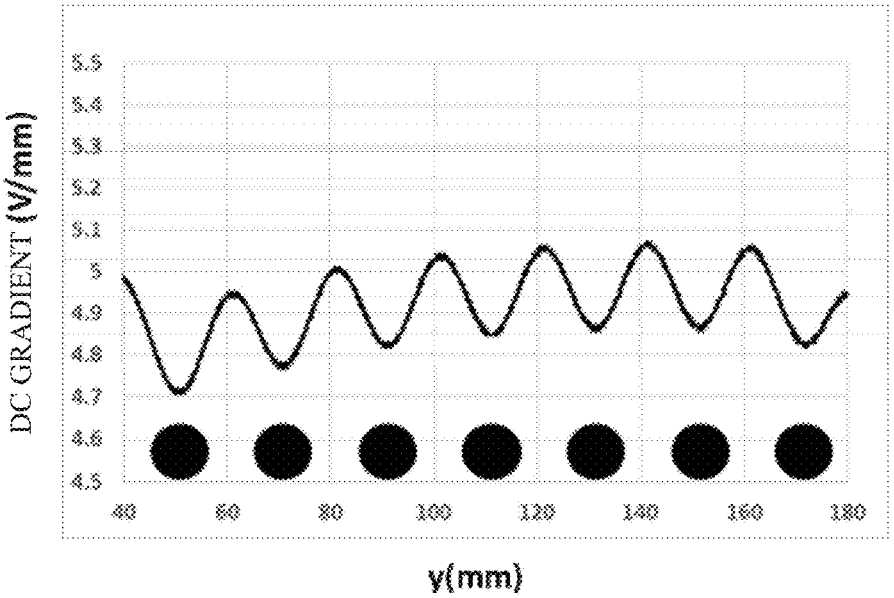
FIG. 4 shows a schematic diagram of a DC gradient distribution on the drift tube in a radial direction in the first embodiment of the mass spectrometer according to the present invention.
Figure 5:
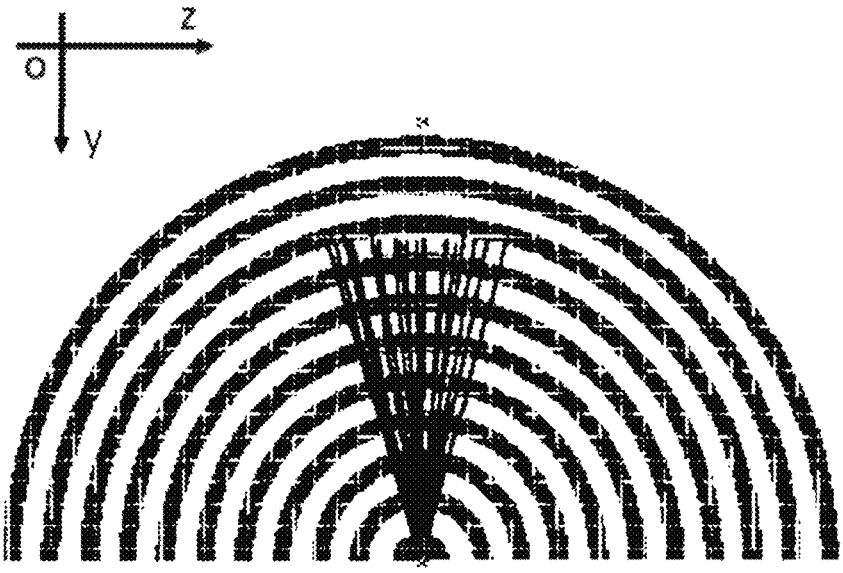
FIG. 5 shows a schematic diagram of a simulated trajectory in a yz plane during the transmission of ions in the drift tube in the first embodiment of the mass spectrometer according to the present invention.
Figure 6:
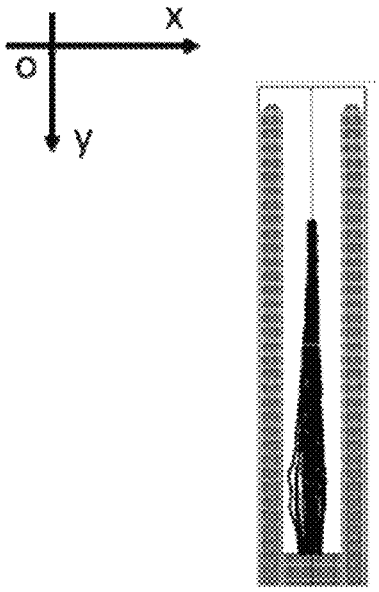
FIG. 6 shows a schematic diagram of a simulated trajectory in an xy plane during the transmission of ions in the drift tube in the first embodiment of the mass spectrometer according to the present invention.

By uniformly applying the DC voltage to the arc electrodes as shown in FIG. 3, a uniform and periodic DC gradient still can be realized, as shown in FIG. 4. In this case, the transmission trajectory of the sample ions is shown in FIGS. 5 and 6. FIG. 5 shows a trajectory of ions in the yz plane, where wider ion beams can be transmitted and focused in the radial direction and then compressed to the vicinity of the center; and, FIG. 6 shows a trajectory of ions in the xy plane, where the ion beams are diffused to a certain extent in the x direction, but the ions are still transmitted at an efficiency of approximately 100%. The reason for the diffusion in the x direction is that there is still a slight over-defocusing effect even though the cross-section of each of the cell electrodes has been modified to be circular or elliptic from rectangular.

(2) A non-uniform DC voltage is applied to each of the cell electrodes.

For example, in order to avoid the over-defocusing of ions, the voltage distribution can be a quadratic curve distribution in the direction of ion drift, that is, the voltage in this direction drops more and more quickly. The increasing voltage gradient will provide an additional ion focusing effect in the x direction.

(3) The width or spacing of the electrodes changes in the direction of ion drift.

For example, in the case where the voltage is uniformly distributed on the cell electrodes, the distance between electrodes can be gradually reduced in the direction of ion drift, so that an additional ion focusing effect is provided.

(4) Very thin (i.e., very narrow) electrodes are used.

In this case, the width of a single electrode in the direction of ion drift and the distance between two electrodes in the x direction do not satisfy the above ratio requirement. However, by adjusting the voltage applied to each electrode, any desired electric field distribution can be obtained. Thus, a periodic focusing electric field can be obtained. However, this solution is complicated and generally requires a special manufacture process, for example, the PCB process.

Therefore, compared with the drift tube in the conventional proton transfer reaction mass spectrometer, the drift tube of the present invention has a very high transmission efficiency. For the conventional DC drift tube, due to the large inner diameter and the small ion outlet, the transmission efficiency generally does not exceed 10%. However, in the present invention, since the drift tube has a periodic ion focusing effect in the x direction and an obvious ion focusing and compression effect in the radial direction, the diffusion of ions can be effectively inhibited, and a transmission efficiency above 80% can be achieved, which is similar to that of the RF focusing technologies like an ion funnel.

Compared with the RF focusing technologies like an ion funnel, the drift tube of the present invention has the following advantages.

(1) Ions will not be heated significantly.

Figure 7:
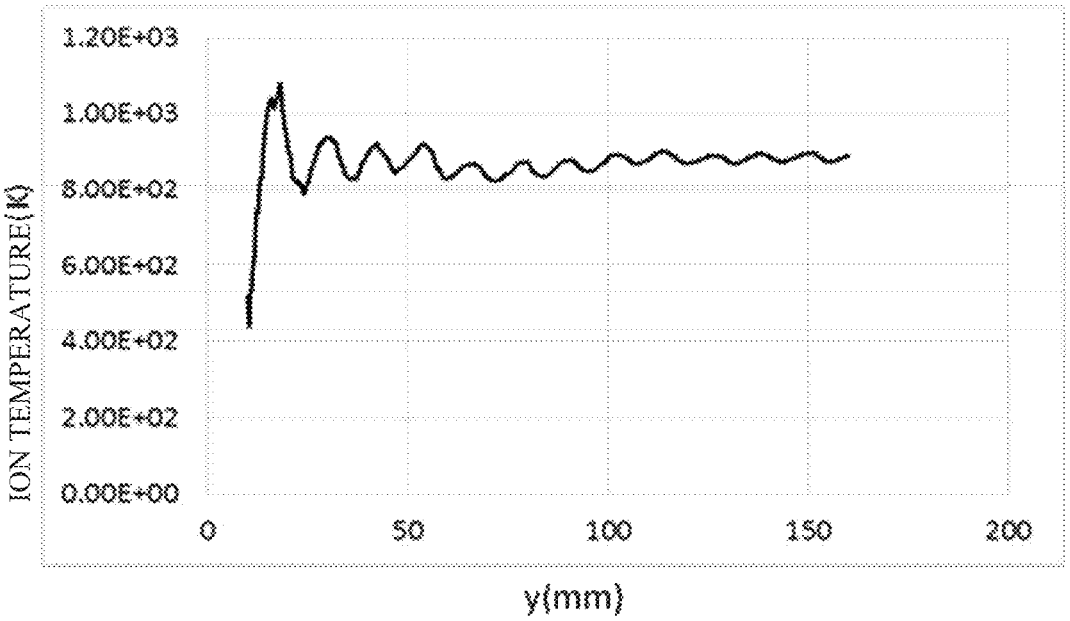
FIG. 7 shows a schematic diagram of the simulated temperature of ions in the drift tube in the first embodiment of the mass spectrometer according to the present invention.

FIG. 7 shows the temperature of ions in the drift tube, which is obtained by computer simulation. During the simulation, the air pressure is 200 Pa, the intensity of the electric field is 60 V/cm, the temperature of ions is equivalently calculated as E/N, i.e., about 120 Td. This is completely consistent with the conventional DC electric field drift tube. Therefore, there will be no water cluster ions, and there will also no fragment ions resulted from obvious cracking. Therefore, an optimal spectrum quality can be realized. However, in the drift tube like an ion funnel, under the same DC electric field intensity, the ions will be significantly heated to about 140 Td even if only a low RF amplitude (e.g., $80V_{P-P}$, 0.5 MHz) is applied.

(2) There is no mass discrimination.

For the ion funnel, low-mass discrimination is likely to occur at the ion outlet due to the RF trapping. However, for the drift tube of the present invention, this problem is overcome, and molecules of a small mass number have a higher transmission efficiency.

(3) Since it is not necessary to apply RF voltage or corresponding RF power supply, the device is relatively simple and the cost is low.

(4) Since the two sets of electrodes in the device are arranged in a planar manner, the device is easily manufactured by a planar process, for example, the PCB process. Therefore, the manufacture difficulty can be reduced greatly.

It is to be noted that, in some particular cases, for example, when it is required to realize further ion trapping in the radial direction (i.e., in a direction perpendicular to the direction of drift), or to heat the ions, or to observe ion fragments, or to remove low-mass ions or the like, the RF voltage can still be applied to the drift tube in the present invention. For example, the RF voltages can be applied to at least part of cell electrodes in each set of electrodes, and the RF voltages on adjacent cell electrodes to which the RF voltages are applied in the direction of drift are equal in amplitude and opposite in phase. In a word, whether an RF voltage is applied or not is not limited in the present invention. Preventing application of an RF voltage is merely to achieve a better spectrum quality in most of analyses.

Embodiment 2

Figure 8:
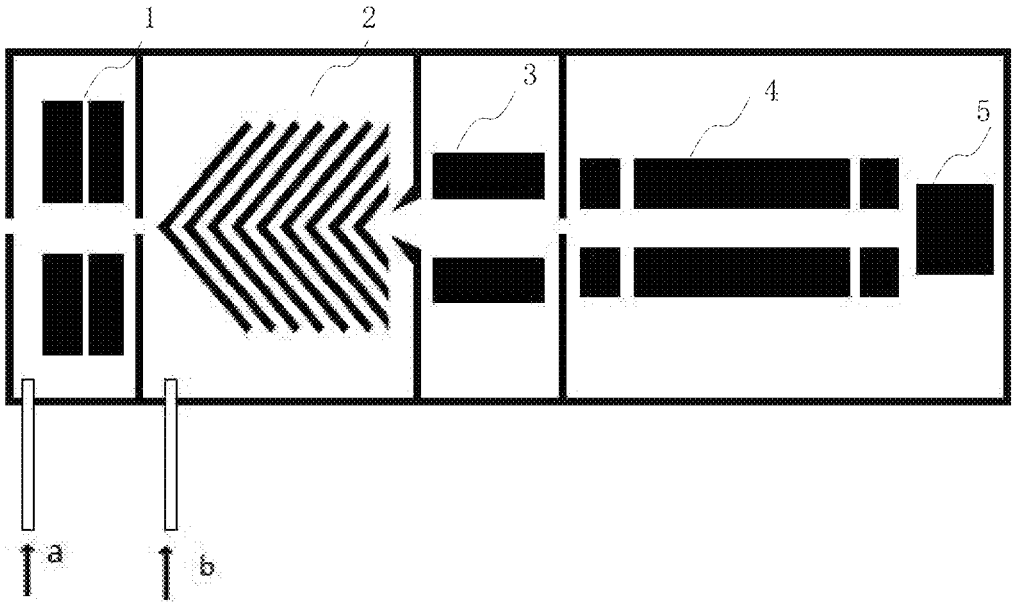
FIG. 8 shows a structure diagram of a second embodiment of the mass spectrometer according to the present invention.
Figure 9:
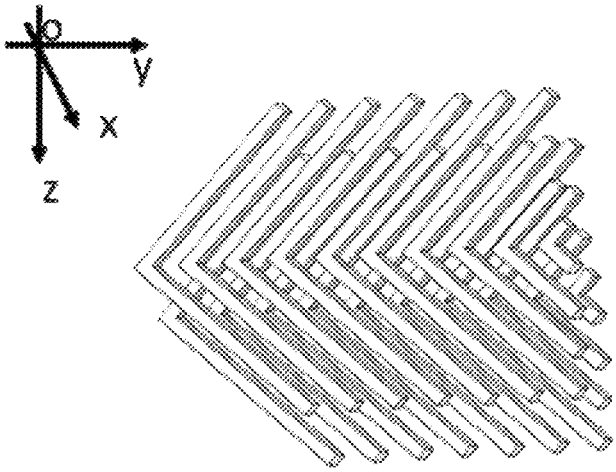
FIG. 9 shows a three-dimensional structure diagram of a drift tube in the second embodiment of the mass spectrometer according to the present invention.

As shown in FIG. 8, a difference between this embodiment and Embodiment 1 lies in that, the arc electrodes are replaced with broken line electrodes, and each set of electrodes includes several broken line electrodes which are distributed in the same plane, have the same axis of symmetry and are arranged in the direction of ion drift. The three-dimensional structure is as shown in FIG. 9. Therefore, in the present invention, the shape of the electrodes of the drift tube is not limited. The electrodes may be curved, and any curved electrodes capable of focusing wide incident ion beams shall fall into the projection scope of the present invention.

Embodiment 3

Figure 10:
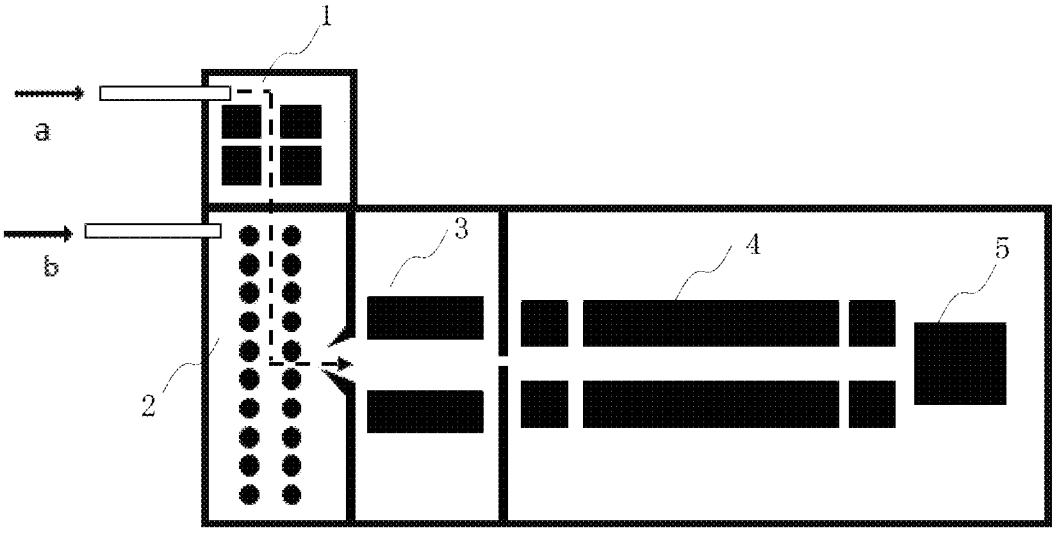
FIG. 10 shows a planar structure diagram of a third embodiment of the mass spectrometer according to the present invention.
Figure 11:
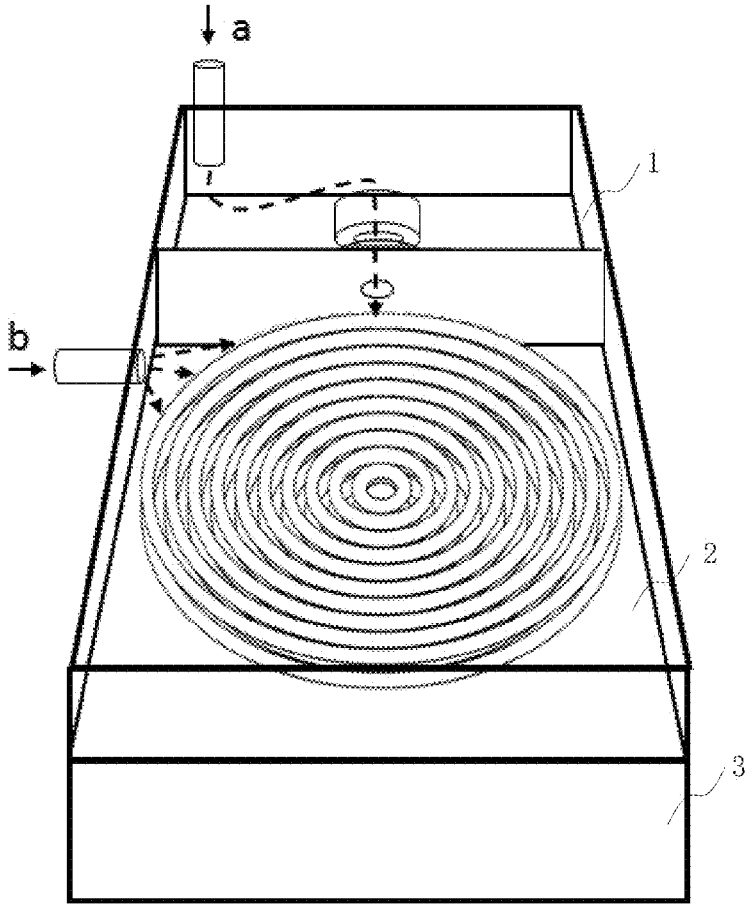
FIG. 11 shows a three-dimensional structure diagram of the third embodiment of the mass spectrometer according to the present invention.
Figure 14:
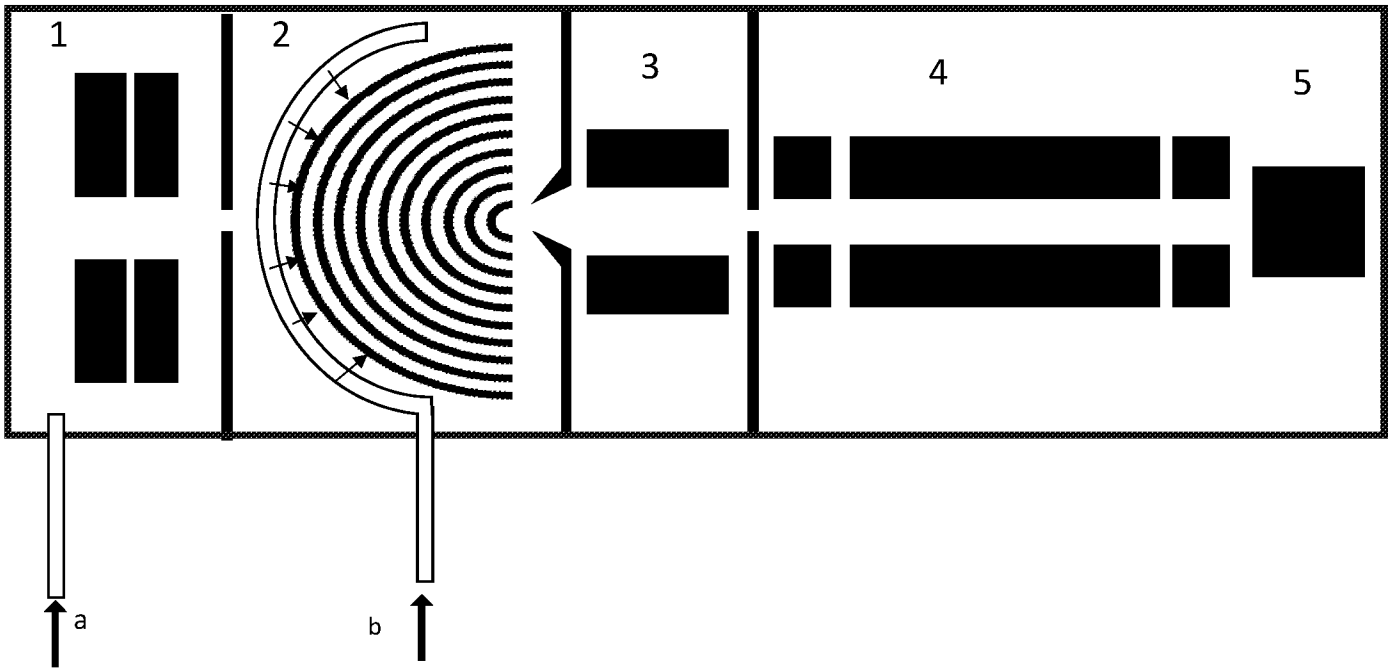
FIG. 14 shows a mass spectrometer where the reagent ions or the sample molecules are introduced from an annular or arc-shaped inlet into the drift tube for reaction according to one embodiment of the present invention.

As shown in FIG. 10, in this embodiment, the cell electrodes are annular electrodes, such that the plane where the two sets of electrodes are located is perpendicular to the direction of the optical axis of the ions in the succeeding stage. With this structure, the instrument becomes more compact, and it is advantageous for the miniaturization of the equipment. Meanwhile, the introduction of the reagent ions and the sample molecules is more flexible. For example, the sample molecules can be introduced along a tangent of the annular electrodes on the outer side, as shown in FIG. 11; or, the sample molecules can be introduced in a direction perpendicular to the plane of the annular electrodes, as shown in FIG. 10; or, the reagent ions and the sample molecules can be distributed around the annular inlet so that they are introduced from the annular inlet, and in this way, the flux of ions can be improved greatly. Of course, the reagent ions and the sample molecules can also be introduced from an annular or arc-shaped inlet b in order to greatly improve the flux of ions, as shown in FIG. 14.

The foregoing embodiments are merely for illustratively describing the principle and effects of the present invention, and not intended to limit the present invention. Those skilled in the art can make modifications or alterations to the embodiments without departing from the spirit and scope of the present invention. Therefore, all equivalent modifications or alterations made by those skilled in the art without departing from the spirit and technical concept of the present invention shall fall into the scope defined by the claims of the present invention.

What is claimed is:

1. A mass spectrometer, comprising:

an ion source configured to generate reagent ions;

a drift tube configured to cause sample molecules to react with the reagent ions to generate sample ions, said drift tube comprising two sets of electrodes which are identical in structure and symmetrically distributed in a direction perpendicular to a direction of ion drift, each set of electrodes comprising a plurality of curved cell electrodes which are distributed in a same plane and arranged in the direction of ion drift so that the sample ions are generated and drifted within a region between said two sets of electrodes and focused in the direction perpendicular to the direction of ion drift;

a power supply device configured to apply, to each of the cell electrodes, a DC only voltage changing in the direction of ion drift, a periodic focusing DC electric field formed by said DC only voltage being used for ion drift in the direction of ion drift and for ion confinement in the direction perpendicular to the direction of ion drift; and a mass analyzer configured to perform mass analysis for the sample ions.

2. The mass spectrometer according to claim 1, wherein the cell electrodes are ring or arc electrodes, and each set of electrodes comprises several ring or arc electrodes which are distributed in a same plane, have a same center and different radii, and extend in the direction of ion drift.

3. The mass spectrometer according to claim 2, wherein a cross-section of each of the ring or arc electrodes in a direction perpendicular to a ring shape or arc shape is circular or elliptic.

4. The mass spectrometer according to claim 1, wherein a ratio of a distance between two cell electrodes distributed in the direction perpendicular to the direction of ion drift to a width of each cell electrode in the direction of ion drift does not exceed 2, and a ratio of the distance between two cell electrodes distributed in the direction perpendicular to the direction of ion drift to a length of a distance between two adjacent cell electrodes in the direction of ion drift does not exceed 2.

5. The mass spectrometer according to claim 1, wherein the DC voltage applied by the power supply device changes uniformly or non-uniformly in the direction of ion drift, to form a periodic DC focusing electric field in the direction of ion drift.

6. The mass spectrometer according to claim 1, wherein the width of the cell electrodes in the direction of ion drift or a spacing between adjacent cell electrodes in the direction of ion drift changes in the direction of ion drift, to form a periodic DC focusing electric field in the direction of ion drift.

7. The mass spectrometer according to claim 1, wherein the DC voltage is in the form of traveling waves.

8. The mass spectrometer according to claim 1, wherein the cell electrodes are broken line electrodes, and each set of electrodes comprises several broken line electrodes which are distributed in a same plane, have a same axis of symmetry and are arranged in the direction of ion drift.

9. The mass spectrometer according to claim 1, wherein the reagent ions are one of inert gas ions, $H_3O^+$, $NO^+$ and $O_2^+$ or a combination thereof.

10. The mass spectrometer according to claim 1, further comprising an ion selection device which is located in a preceding stage of the drift tube to select one or more of the reagent ions.

11. The mass spectrometer according to claim 1, wherein a pressure in the drift tube ranges from 100 Pa to 400 Pa.

12. The mass spectrometer according to claim 1, wherein the mass analyzer is a quadrupole mass filter, a time-of-flight mass analyzer, an ion trap mass analyzer or a Fourier transform mass analyzer.

13. The mass spectrometer according to claim 1, wherein each set of electrodes is distributed on a same printed circuit board substrate.

14. The mass spectrometer according to claim 1, wherein the reagent ions or the sample molecules are introduced from an annular or arc-shaped inlet into the drift tube for reaction.

* * * * *